US007237867B2

(12) United States Patent
Chiun

(10) Patent No.: US 7,237,867 B2
(45) Date of Patent: Jul. 3, 2007

(54) INK CLEANING DEVICE OF THE INKJET PRINTER

(76) Inventor: Kuan Ta Chiun, 1F, No.131, Hsin-Chuang Rd., Hsin-Feng Shiang, Hsin-Chu (TW)

( * ) Notice: Subject to any disclaimer, the term of this patent is extended or adjusted under 35 U.S.C. 154(b) by 215 days.

(21) Appl. No.: 10/813,674

(22) Filed: Mar. 31, 2004

(65) Prior Publication Data

US 2004/0223026 A1 Nov. 11, 2004

(30) Foreign Application Priority Data

Mar. 31, 2003 (TW) ..... 92205024 U

(51) Int. Cl.
*B41J 2/165* (2006.01)

(52) U.S. Cl. ..... 347/22; 347/23; 347/29; 347/30; 347/33

(58) Field of Classification Search ..... 347/22–35
See application file for complete search history.

(56) References Cited

U.S. PATENT DOCUMENTS 5,754,197 A * 5/1998 Shibata ..... 347/22
6,375,301 B1 * 4/2002 Childers et al. ..... 347/28

* cited by examiner

*Primary Examiner*—Shih-Wen Hsieh

(57) ABSTRACT

This invention is related to an ink cleaning device, wherein this device comprises a cartridge stand, a driving mechanism, a printing control device and a cleaning cartridge. The feature of this invention is when the cleaning cartridge is put in the cartridge stand to replace the ink cartridge; the cleaning cartridge will be driven to guide cleanser into the guide tube and the printing head for cleaning purpose. Besides, the cartridge stand can accommodate the ink cartridge and the cleaning cartridge at one time. When ink cleaning function is required, the cleaning cartridge will be driven directly to clean the ink out by printing control device which is driven by an external device. The function of cleaning will also be approached.

14 Claims, 4 Drawing Sheets

INK CLEANING DEVICE OF THE INKJET PRINTER

FIELD OF THE INVENTION

The present invention relates to an ink cleaning device, and more particularly to an ink cleaning device applied to an inkjet printer. This device provides an ink cleaning function in the inkjet printer. The guide tube and the printing head won't be jammed because ink is cleaned out.

BACKGROUND OF THE INVENTION

The printer becomes a necessary appliances for modern people in these days, when people always use it at work or entertainment specially. At this moment, the type of printer comprises a laser printer, a dot matrix printer, and an inkjet printer. Focusing to the economic price, a highly development and low cost, the inkjet printer has become a main stream of the other printers.

There are two design trend at present of an ink cartridge of an inkjet printer. One is the ink cartridge has a printing head thereon. User can replace the ink cartridge directly when ink is run out, and then user has replaced the printing head at the same time. It will be convenient for use because user don't need to clean the printing head anymore, but it will get a higher cost and selling price; The other is the ink cartridge has not a function of printing head, in the other word, the printing head is set in a cartridge stand of inkjet printer instead of the ink cartridge. Please refer to FIG. 1. A conventional inkjet printer comprises a cartridge stand 10, a driving mechanism 14, and a printing control device 16, wherein the cartridge stand 10 comprises a printing head 100, which can control the flow rate of the ink; an ink cartridge 12 guides the ink into the printing head 100 when it is put in the cartridge stand 10. The driving mechanism 14 is used to drive the cartridge stand 10 for moving through a direction like the arrow of FIG. 1. The printing control device 16 is electronically connected to the driving mechanism 14 and the printing head 100 for controlling the movement of the cartridge stand 10, and the inkjet action of the printing head 100 at right time to achieve the printing function. The above-mentioned structure can save the cost of replacing printing head, however, due to a long time idle, it will cause the printing head 100 or/and the guide tube 102 is usually jammed because the ink is dried therein. The inkjet printer is usually out of order for these reasons.

SUMMARY OF THE INVENTION

An object of the present invention is to provide an ink cleaning device, specially applied to an inkjet printer, wherein the ink cleaning device has a function of cleaning ink to prevent the guide tube or printing head form being jammed.

According to above-mentioned ideas, the ink cleaning device of the inkjet printer of this invention at least comprises a cartridge stand, which bear an ink cartridge, wherein the cartridge stand comprising a printing head; a driving mechanism can drive the cartridge stand to move through a predetermined direction; and a printing control device electronically connected to the cartridge stand for controlling the inkjet action of the printing head; and electronically connected to the driving mechanism for controlling the movement of the cartridge stand. The feature of the present invention is that the ink cleaning device comprising a cleaning cartridge, which accommodate the cleanser, and the printing control device produces a signal when the cleaning cartridge is replaced the ink cartridge to be put in the cartridge stand. The inkjet printer will process an ink cleaning action according to the signal.

According to above-mentioned ideas, the cartridge stand comprising a detecting device, such as a single-cut switch, which can produce a signal when the cleaning cartridge is replaced the ink cartridge to be put in the cartridge stand, the inkjet printer will process an ink cleaning action according to the signal.

According to above-mentioned ideas, the printing control device send the signal to an external device, such as a computer, when the cleaning cartridge is replaced the ink cartridge to be put in the cartridge stand, and then the external device can control the inkjet printer to process an ink cleaning action according to the signal.

According to above-mentioned ideas, the present invention provides another embodiment shown as follows: the ink cleaning device of the inkjet printer of this invention at least comprises a cartridge stand, which can bear an ink cartridge and a cleaning cartridge simultaneously, wherein the cartridge stand comprises a printing head and a control valve; a driving mechanism can drive the cartridge stand to move through a predetermined direction; and a printing control device electronically connected to the cartridge stand for controlling the inkjet action of the printing head; and electronically connected to the driving mechanism for controlling the movement of the cartridge stand; and further electronically connected to the control valve for controlling the flow rate of the cleanser. The feature of this embodiment is that the printing control device drive the control valve to start the inkjet printer to process an ink cleaning action when the printing control device accept a signal.

According to above-mentioned ideas, the cleaning cartridge comprises an opening for injection of the cleanser.

According to above-mentioned ideas, the cleaning cartridge is fixed in the cartridge stand.

According to above-mentioned ideas, the cartridge stand comprises a detecting device, such as a single-cut switch, which can produce a signal when the cleaning cartridge is put in the cartridge stand, the inkjet printer will process an ink cleaning action according to the signal.

According to above-mentioned ideas, the signal can also be produced by an external device, such as a computer or a button, which can produce a signal when the button is pressed.

According to above-mentioned ideas, the cleanser can be selected from acetone, alcohol, tetra-chloromethane, and a combination thereof.

BRIEF DESCRIPTION OF THE DRAWINGS

The present invention may best be understood through the following description with reference to the accompanying drawings, in which.

DETAILED DESCRIPTION OF THE INVENTION

Figure 1:
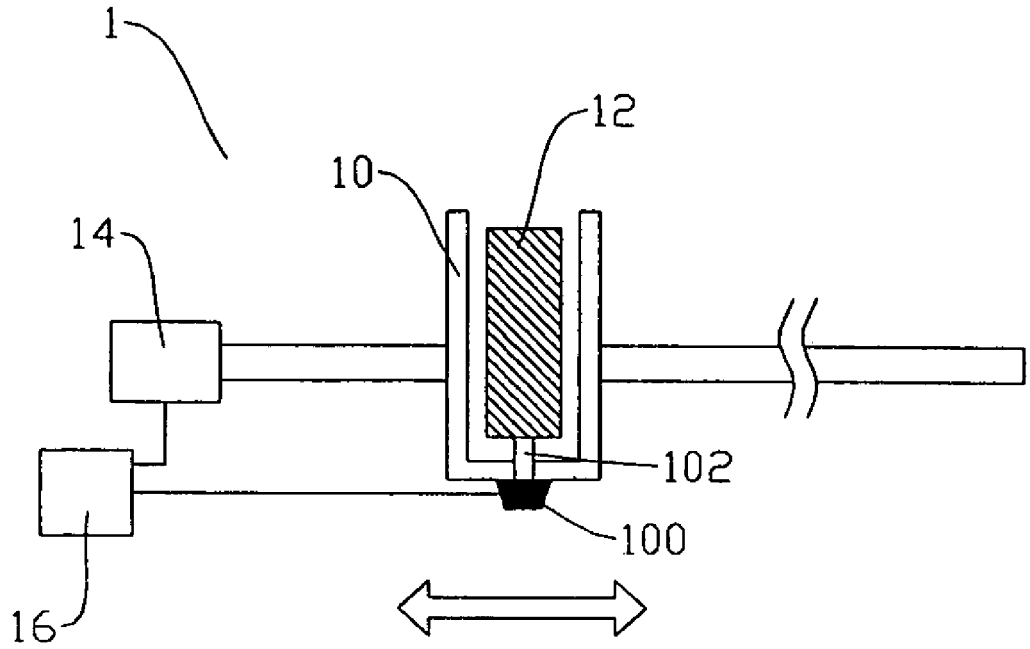
FIG. 1 is a diagram of a conventional inkjet printer for printing.
Figure 2:
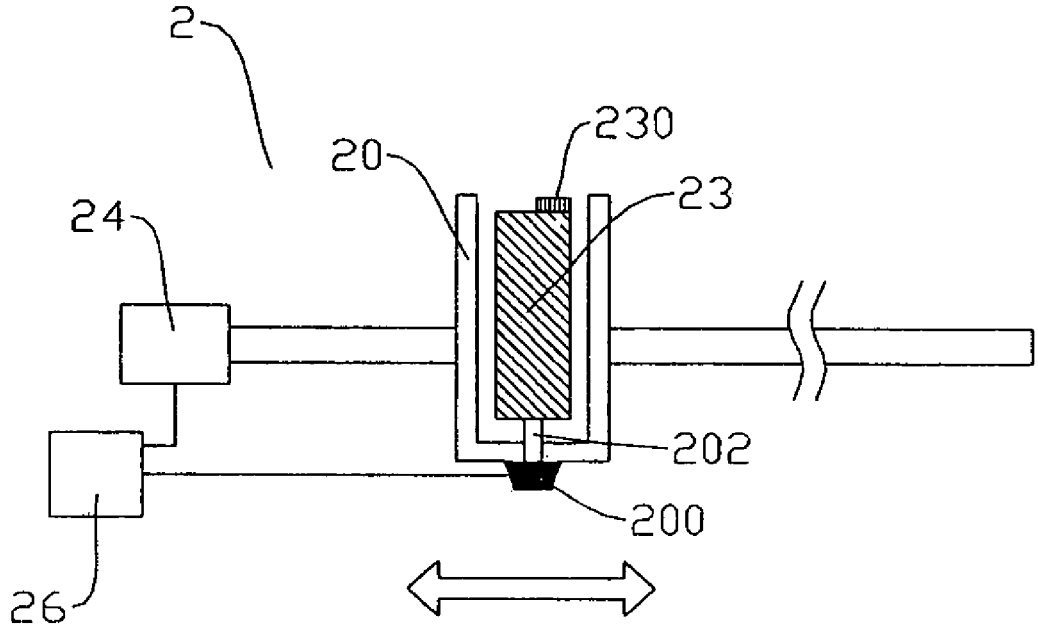
FIG. 2 is a diagram of the ink cleaning device of the inkjet printer, according to the first embodiment of the present invention.

Please refer to FIG. 2. The ink cleaning device of the inkjet printer comprises a cartridge stand 20, a driving mechanism 24, a printing control device 26, and a cleaning cartridge 23. The function of printing is equivalent to a conventional printer; but the present invention provides a feature when the cleaning cartridge 23 is put in the cartridge stand 20 to replace the ink cartridge 12, referring to FIG. 1, the cleaning cartridge 23 is thus driven to clean the ink by blowing the cleanser to the guide tube 202 or/and the printer head 200. The purpose of cleaning ink will be approached. The detail description of the operation of cleaning will be shown thereinafter.

Figure 3A:
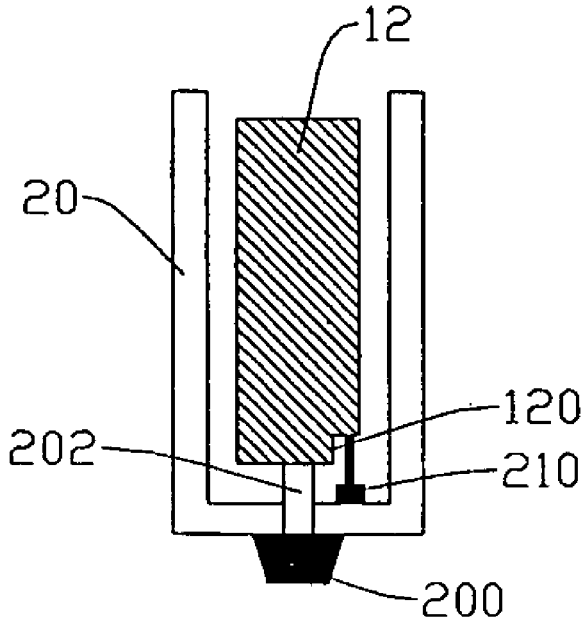
FIG. 3A to 3D are the detail diagram of the detecting device of the ink cleaning device of the inkjet printer according to the present invention.
Figure 3B:
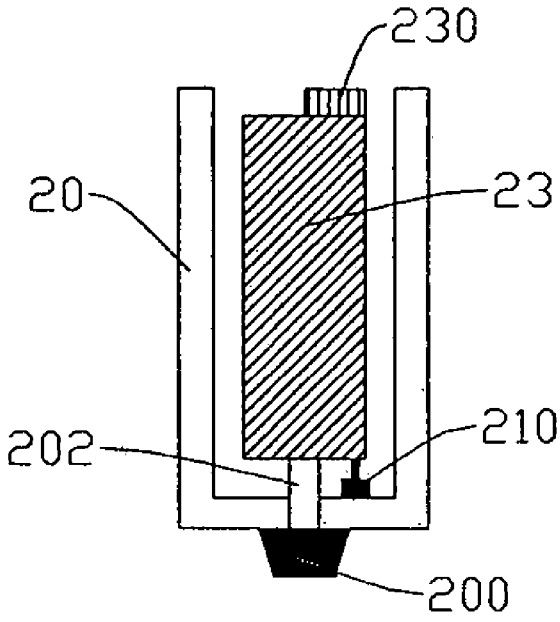
Figure 3C:
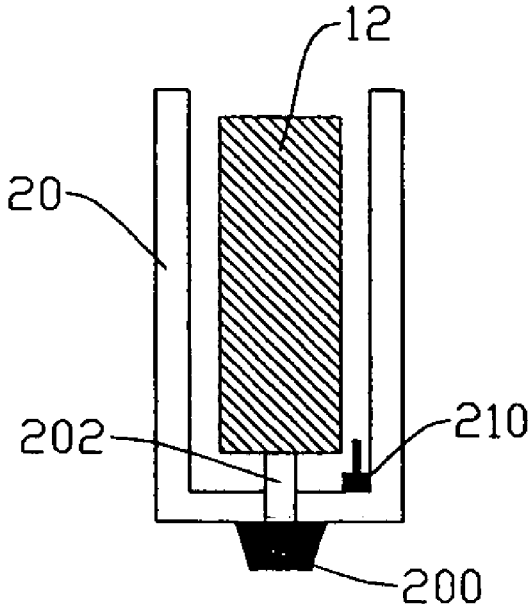
Figure 3D:
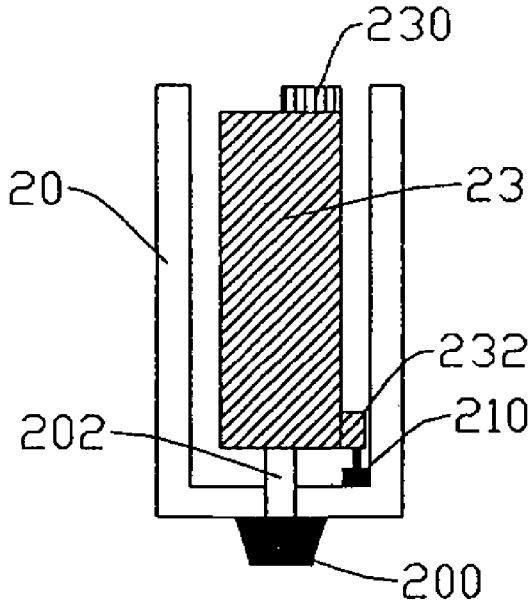

When the cleaning cartridge 23 is put in the cartridge stand 20, the cartridge stand 20 will produce a signal to announce the printing control device 26 to process the cleaning ink action. The cartridge stand 20 comprises a detecting device, such as a single-cut switch or a photo-electronic switch, which is used to distinguish whether the ink cartridge 12 or the cleaning cartridge 23 is put in the cartridge stand 20. Please refer to FIG. 3A to 3B for an embodiment of the detecting device. For matching up above-mentioned detecting device, the ink cartridge 12 can be designed to have an indentation 120 on the bottom; nevertheless, the cleaning cartridge 23 has no such kind of design. When the cleaning cartridge 23 is put in the cartridge stand 20, the detecting device 210 will be pressed down if the detecting device 210 is a single-cut switch, or be approached if the detecting device 210 is a photo-electronic switch, the detecting device 210 will produce a signal to announce the printing control device 26 to process the cleaning procedure. It is one way to reach the distinguishing purpose and contrariwise. Please refer to FIG. 3C to 3D for another embodiment of the detecting device, the cleaning cartridge 23 can be designed to have a protrusion 232 on the bottom; nevertheless, the ink cartridge 12 has no such kind of design. When the cleaning cartridge 23 is put in the cartridge stand 20, the detecting device 210 will be pressed down if the detecting device 210 is a single-cut switch, or be approached if the detecting device 210 is a photo-electronic switch, the detecting device 210 will produce a signal to announce the printing control device 26 to process the cleaning procedure. It is one way to reach the distinguishing purpose and contrariwise.

The printing control device 26 will begin to process the cleaning procedure when the printing control device 26 receives the signal from the detecting device 210. Then, the printing control device 26 will drive the printing head 200 to draw the cleanser from the cleaning cartridge 23 through the guide tube 202. The cleanser can be a king of material to dissolve ink, such as acetone, alcohol, tetra-chloromethane, or a combination thereof. Hence, the ink will be dissolved and cleaned out when the cleanser flow through the guide tube 202 and/or the printing head 200, and be sprayed out of the printing head 200. Furthermore, the driving mechanism 24 can drive the cartridge stand 20 to move to a specific position (not shown) to do the foregoing cleaning procedure.

Figure 4:
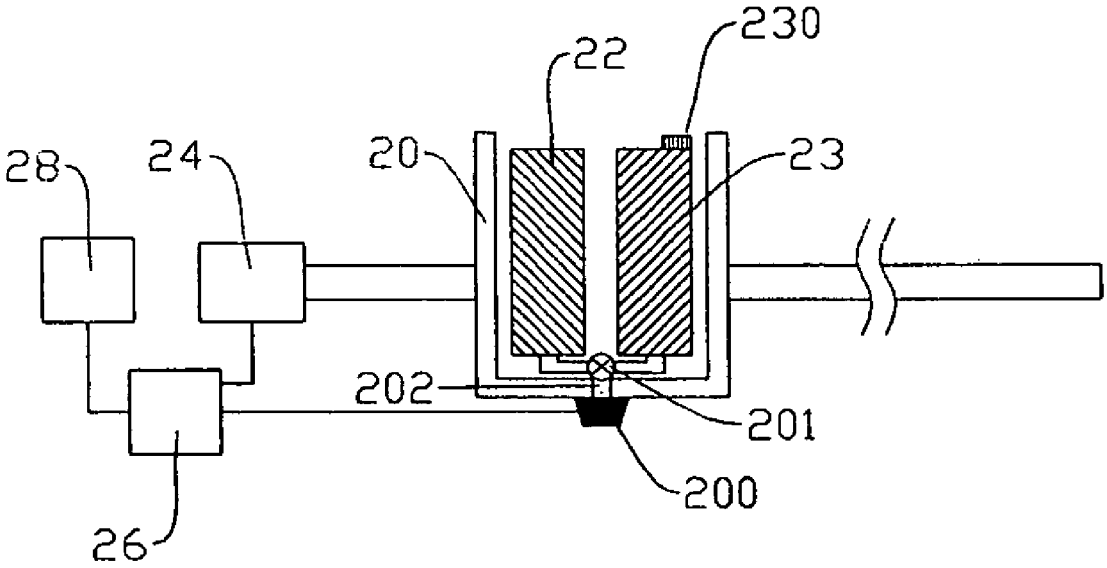
FIG. 4 is a diagram of the ink cleaning device of the inkjet printer, according to the second embodiment of the present invention.
Figure 5:
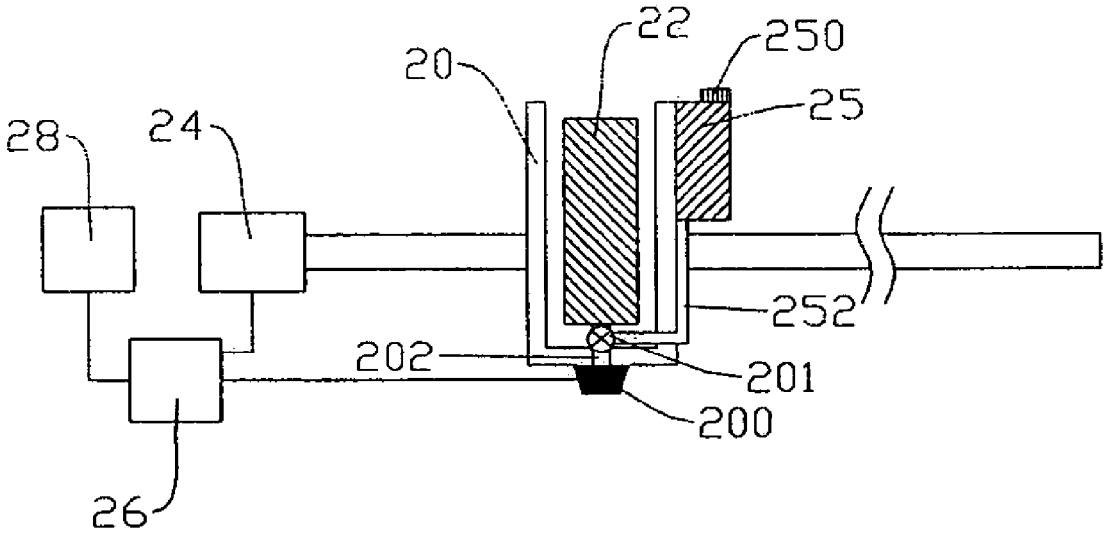
FIG. 5 is a diagram of the ink cleaning device of the inkjet printer, according to the third embodiment of the present invention.

Please refer to FIG. 4, which is shown another embodiment of the present invention. The main structure is similar to above embodiment but cartridge stand. The cartridge stand 20 comprises a printing head 200 and a control valve 201, wherein the control valve 201 will decide whether the cleanser will go or not, even the flow rate of the cleanser. On the basis of this structure, the cartridge stand 20 can accommodate the ink cartridge 22 and the cleaning cartridge 23 simultaneously. It will not necessary to replace ink cartridge 22 by cleaning cartridge 23 during cleaning procedure. The cleaning ink purpose will also be reached by an external device 28, which drive the printing control device 26 directly. The detail description of the operation of cleaning will be shown thereinafter.

In this embodiment, user can start the cleaning function by an external device 28 when necessary. Furthermore, the external device 28 can be a button, which is positioned outside the inkjet printer. The external device 28 can be a computer, too, wherein the computer is electronically connected to the inkjet printer, which has the software inside for driving printer. When the button is pressed or the software of the computer is driven, the external device 28 will produce a signal, and then the printing control device 26 will receive the signal to announce the control valve 201 to work. Therefore, the cleanser can pass through the control valve 201 at this time, but the ink can't. The printing control device can be designed to employ the printing head 200 to draw the cleanser to clean the ink in the guide tube 202 and the printing head 200 directly.

According to the above embodiment, wherein the cleaning cartridge can be changed individually by pulling out the cartridge stand. The cleaning cartridge will be replaced when it is run out. The second way is that the cleanser will be injected to the cleaning cartridge 23 through an opening 230. The other way, please refer to FIG. 4, the cartridge stand 20 comprises a fixed cleaning cartridge 25 outside, wherein the cleaning cartridge 25 comprises a cleaning tube 252 connect to the control valve 201 from the bottom of the cleaning cartridge 25, and an opening 250 for injecting the cleanser. User won't replace the cleaning cartridge by pulling it out when the cleanser is run out. The printer also has the cleaning function like the above-mentioned embodiment.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An ink cleaning device is applied to an inkjet printer; the ink cleaning device comprising:

a cartridge stand bearing an ink cartridge, wherein the cartridge stand comprising a printing head;

a driving mechanism driving the cartridge stand to move through a predetermined direction; and a printing control device electronically connected to the cartridge stand for controlling the inkjet action of the printing head; and electronically connected to the driving mechanism for controlling the movement of the cartridge stand;

wherein the ink cleaning device comprising a cleaning cartridge, which accommodate a cleanser; the printing control device producing a signal when the cleaning cartridge is replaced the ink cartridge to be put in the cartridge stand, the inkjet printer will processing an ink cleaning action according to the signal wherein the cartridge stand comprising a detecting device, which produce a signal when the cleaning cartridge is replaced the ink cartridge to be put in the cartridge stand, the inkjet printer will processing an ink cleaning action according to the signal.

2. An ink cleaning device according to claim 1 wherein the detecting device is a single-cut switch, which produce a signal when the cleaning cartridge is replaced the ink cartridge to be put in the cartridge stand, the inkjet printer will processing an ink cleaning action according to the signal.

3. An ink cleaning device according to claim 1 wherein the cleanser is selected from acetone, alcohol, tetra-chloromethane, and a combination thereof.

4. An ink cleaning device according to claim 1 wherein the cleaning cartridge comprising an opening for injecting the cleanser.

5. An ink cleaning device according to claim 1 wherein the printing control device send the signal to an external device when the cleaning cartridge is replaced the ink cartridge to be put in the cartridge stand, the external device control the inkjet printer to process an ink cleaning action according to the signal.

6. An ink cleaning device according to claim 5 wherein the external device is a computer.

7. An ink cleaning device is used in an inkjet printer; said ink cleaning device comprising:

a cartridge stand carried an ink cartridge and a cleaning cartridge, wherein the cartridge stand comprising a printing head and a control valve;

a driving mechanism driving the cartridge stand to move through a predetermined direction; and a printing control device electronically connected to the cartridge stand for controlling the inkjet action of the printing head; and electronically connected to the driving mechanism for controlling the movement of the cartridge stand; and further electronically connected to the control valve for controlling the flow rate of the cleanser wherein the printing control device drive the control valve to start the inkjet printer to process an ink cleaning action when the printing control device accept a signal wherein the cartridge stand comprising a detecting device which produce a signal when the cleaning cartridge is put in the cartridge stand, the inkjet printer will process an ink cleaning action according to the signal.

8. An ink cleaning device according to claim 7 wherein the cleaning cartridge comprising an opening for injecting the cleanser.

9. An ink cleaning device according to claim 7 wherein the cleaning cartridge is fixed in the cartridge stand.

10. An ink cleaning device according to claim 7 wherein the detecting device is a single-cut switch, which produce a signal when the cleaning cartridge is put in the cartridge stand, the inkjet printer will process an ink cleaning action according to the signal.

11. An ink cleaning device according to claim 7 wherein the signal is produced by an external device.

12. An ink cleaning device according to claim 11 wherein the external device is a computer.

13. An ink cleaning device according to claim 11 wherein the external device is a button, which produce a signal when the button is pressed.

14. An ink cleaning device according to claim 7 wherein the cleanser is selected from acetone, alcohol, tetra-chloromethane, and a combination thereof.

* * * * *